US006381889B1

(12) United States Patent
Knapp

(10) Patent No.: US 6,381,889 B1
(45) Date of Patent: May 7, 2002

(54) INTERLOCKING SLIDE-POCKET FOR ROLL-UP SIGNS

(75) Inventor: Michael Knapp, Elmira, NY (US)

(73) Assignee: Eastern Metal of Elmira, Inc., Elmira, NY (US)

( * ) Notice: Subject to any disclaimer, the term of this patent is extended or adjusted under 35 U.S.C. 154(b) by 0 days.

(21) Appl. No.: 09/665,866

(22) Filed: Sep. 20, 2000

(51) Int. Cl.[7] ..... G09F 17/00
(52) U.S. Cl. ..... 40/612; 40/603; 160/378
(58) Field of Search ..... 40/610, 612, 603, 40/604; 24/625; 116/63 P; 160/377, 378, 379

(56) References Cited

U.S. PATENT DOCUMENTS

| | | | | |
|---|---|---|---|---|
| 1,873,178 A | | 8/1932 | Bernstein | |
| 2,484,096 A | | 10/1949 | Kay | |
| 3,143,817 A | | 8/1964 | Paulson | |
| 3,200,786 A | | 8/1965 | Swezy et al. | |
| 3,473,248 A | | 10/1969 | Laebe | |
| 3,526,200 A | | 9/1970 | Doyle | |
| 3,677,511 A | | 7/1972 | Dicke | |
| 3,899,843 A | | 8/1975 | Doyle et al. | |
| 4,015,802 A | | 4/1977 | Heredia | |
| 4,019,271 A | | 4/1977 | Latimer | |
| 4,288,053 A | | 9/1981 | Sarkisian | |
| 4,408,375 A | * | 10/1983 | Skobel | 24/625 |
| 4,426,800 A | | 1/1984 | Brown | |
| 4,481,729 A | | 11/1984 | Weiller | |
| 4,490,934 A | | 1/1985 | Knapp | |
| 4,888,894 A | | 12/1989 | Brown, Jr. | |
| 5,152,091 A | | 10/1992 | Leach | |
| 5,446,984 A | | 9/1995 | Kulp et al. | |
| 5,729,926 A | | 3/1998 | Cowgill et al. | |

FOREIGN PATENT DOCUMENTS

| | | | | |
|---|---|---|---|---|
| FR | 438533 | * | 5/1912 | 24/625 |

* cited by examiner

*Primary Examiner*—Cassandra H. Davis
(74) *Attorney, Agent, or Firm*—Akin, Gump, Strauss, Hauer & Feld, L.L.P.

(57) ABSTRACT

A bracing sleeve which includes a base portion and a cover portion. The base portion of the sleeve is affixed along a bracing surface of a flexible sign. The base portion includes a batten recess for receiving the terminal end of a batten. The batten recess is defined by walls disposed along longitudinal sides of the base portion in opposing relation and extending outwardly from the base portion. The walls define tracks along the base wall longitudinal sides. The cover portion includes a recess side and an exterior side, the cover portion is in sliding engagement with the base portion. The cover portion is movable between a first position wherein the batten recess is exposed, and a second interlocked position wherein the batten recess is enclosed by the cover portion. The cover portion and said base portion include releasable interlocking elements which cooperate to releasably interlock the cover portion in the second position. In this way, a batten terminal end is secured to the bracing sleeve upon slidably engaging the cover portion from the first position to the second position with the batten end positioned within the base portion recess.

15 Claims, 4 Drawing Sheets

INTERLOCKING SLIDE-POCKET FOR ROLL-UP SIGNS

BACKGROUND OF THE INVENTION

This invention relates generally to sign assemblies, and, more specifically, to collapsible sign assemblies requiring a minimum of assembly time and effort for rapid deployment, such as those typically found in roadway construction and maintenance work zones.

Collapsible sign assemblies are known wherein a flexible sign material is tensioned by supporting structure for creating a display surface. The flexible material is typically tensioned by resilient fiberglass reinforced plastic battens of varying thickness, which are secured to the flexible sign material by a variety of fastening means. Typically, one or more battens are secured in fixed-pockets which are disposed at opposing locations along a rear surface of the flexible sign. However, fixed-pockets create difficulty in assembly as the resilient batten must be significantly flexed using manual force before the insertion of its unsecured end portion into a fixed-pocket is possible.

Fixed-pockets for securing a batten end portion therein are known and have been developed in two basic types: a pliable fabric type which is typically sewn directly to the rear surface of the flexible sign, and a rigid or semi-rigid molded plastic type which is typically affixed to the rear surface of the flexible sign with mechanical fasteners. Both fixed-pocket types have as their single purpose to secure a batten end portion therein, and thus tension the flexible fabric sign. When fixed-pockets of either type described are employed, the operator is always required to flex the resilient batten prior to inserting its unsecured end portion into a fixed-pocket. Flexing of the fiberglass reinforced plastic battens of varying thickness has become more difficult and much more of a safety concern with the advent of thicker, stiffer, and hence less resilient battens, which in turn are both more awkward to flex and require much more arm strength and effort from the operator than was previously required with the original, more flexible battens. Significant hand-eye coordination, ample arm strength, and the use of two hands, have become prerequisites for inserting the end portion of the newer, less flexible, resilient batten ends into fixed pockets. In fact, some roll-up sign assemblies cannot utilize the newer, less resilient battens with any of the known fixed-pockets because most people do not possess adequate arm strength to flex the batten sufficiently to insert the unsecured end portion into a fixed-pocket; the resilient batten is often just too stiff, and flexing the batten sufficiently to insert its unsecured end portion into a fixed pocket is unachievable by the operator. In attempting to do so, an operator risks losing control of the batten while it is being flexed during the insertion attempt, which could easily lead to serious injury if the resilient batten were to unexpectedly and instantaneously spring back and hit the operator.

More recently, two-piece mechanical fastener pockets with a friction-fit closure have been developed in which separate fastening means are provided and attached to the rear surface of the flexible sign material for securing the batten therein without the requirement of first flexing the resilient batten. However, these pockets still require two handed assembly in order to close the pocket to secure a batten end into and unsecure a batten end from an opposing pocket. Two-piece mechanical fastener pockets with a friction-fit closure are inherently awkward and often difficult to open and close due to their reliance on a tight friction fit closure, are unreliable in that they may inadvertently pop-open in strong winds, and if damaged, are not replaceable without specialized tools, and even if the appropriate tools are available, the entire two-piece pocket must be removed from the rear surface of the sign and new separate pieces reattached. Similarly, pockets are desired which can be readily utilized with all resilient battens, regardless of their flexibility or rigidity, and which can be easily secured with one hand, and easily replaced if damaged.

Of further concern, regardless of the specific batten or pocket assembly in use, is the time and attention required of an operator to accomplish the task of tensioning or untensioning a roll-up sign while working in less than ideal conditions, such as those encountered in construction or maintenance work zones where traffic is often moving at high speeds and/or changing lanes, and drivers and workers are often distracted by the various activities taking place around them, or are just not paying adequate attention for the circumstances. Adverse weather conditions, and/or inadequate lighting or night work, may also be contributing factors in making the operator's job of tensioning a roll-up sign more difficult. When combined, any or all of these considerations can only contribute to the peril the operator is in when assembly or disassembly of a collapsible sign is required. Add to the assembly operation the additional requirement(s) that the operator needs both hands, significant arm strength, and a minimum level of hand-eye coordination for inserting and/or securing a batten end portion into a securing pocket, particularly when the newer, less flexible battens are part of the assembly, and it is easy to understand the desirability of a pocket which would greatly shorten the assembly time, as well as reduce the physical requirements of the operator.

Accordingly, the interlocking slide-pocket in accordance with the present invention provides means for securing a batten to a flexible sign material wherein the operator can secure a batten end portion within the appropriate opposing pocket with one hand, regardless of the flexibility or lack thereof of the batten itself, with almost no arm strength or hand-eye coordination required. In fact the present invention can literally be accomplished in total darkness, in a matter of seconds, even if a totally rigid, totally unresilient batten were utilized.

Another, equally important result with the present invention which utilizes a sliding cover and a positive interlock between the cover portion and the base portion, is that a batten end is much less likely to pop-out of a pocket during deployment of the collapsible sign assembly, a common occurrence when a fixed pocket is utilized and the batten is not secured at one or more mid-points by a secondary restraint. Fixed pockets typically must have an abbreviated or shortened sleeve portion so as to allow entrance of the unsecured batten end portion while it is being momentarily flexed for insertion by the operator. Thus, fixed-pockets capture a significantly smaller length of the batten end portion than the length of batten end portion captured by the present invention.

Collapsible roll-up signs not equipped with the present invention are therefore more likely to also require a complicated costly, and somewhat time consuming to operate, temporary secondary restraint to maintain the batten end portions within the fixed pocket than the permanent secondary restraint employable with the present invention. More particularly, conventional roll-up signs are often secured to the battens at points intermediate the terminal ends of the battens to prevent the roll-up sign from bowing when wind impacts the rear surface of the roll-up sign. Typically, velcro straps are used to secure the batten to the roll-up signs at such intermediate points. The use of velcro straps is time consuming and costly. The present invention avoids the need for velcro straps, as discussed in more detail below.

Thus the positive interlocking sliding cover in the present invention allows an additional safety feature in that the batten, regardless of how resilient or flexible it is or is not, may be permanently affixed to the rear surface of the flexible sign by one or more permanent secondary restraints, which do not have to be tied or untied each time the sign is assembled or unassembled, as do the temporary secondary restraints utilized when fixed pockets are part of the collapsible roll-up sign assembly. Permanent secondary batten restraints employable with the present invention prevent the battens from flexing sufficiently to allow the batten end the option to remove itself from the pocket at an inappropriate time, such as while it is deployed, and is subsequently struck by strong winds or a turbulent gust created by a passing vehicle, and at the same time still allow quick and simple one hand removal or insertion when it is appropriate for the batten end portion to be relocated relative to the securing pocket. An added feature of the present invention is that the batten may be removed from the pocket without first requiring removal of the roll-up sign from its support, or for that matter, without removing the batten from the rear surface of the sign. In fact, at least one of the battens utilized in the roll-up sign assembly are thus able to be permanently attached to the rear surface of the sign by a permanent secondary restraint means, making it impossible for the battens to be separated from the sign assembly at any time, which creates another safety advantage, in that the operator will not arrive at the deployment site with a collapsible sign with missing battens.

Another significant improvement of the present invention over all other pocket types, is the fact that if the pocket cover portion is ever damaged in the field and thus rendered inoperable, it is easily and quickly replaceable on the spot, without the use of specialized tools. A pry tab integral to the interlocking cover portion is easily pried up thus allowing removal of the cover portion; and just as quickly a new cover is simply slid into the base portion of the interlocking pocket in a matter of seconds, without removing the base portion from the rear of the flexible sign.

BRIEF SUMMARY OF THE INVENTION

Briefly stated, the present invention is directed to a sign assembly. The sign assembly includes a flexible sheet of material in the form of a sign has a display surface and an opposing bracing surface. A first batten has terminal ends for engaging the flexible sheet along a bracing axis of the bracing surface. A second batten has terminal ends and is oriented along a second bracing axis of the bracing surface. The sign assembly also includes at least one bracing sleeve that has a base portion and a cover portion. The base portion of the sleeve is affixed to the bracing surface at a location along the bracing axis. The base portion includes a batten recess for receiving a batten terminal end. The batten recess is defined by walls disposed along longitudinal sides of the base portion in opposing relation and extending outwardly from the base portion. The walls define tracks along the base portion longitudinal sides. The cover portion includes a recess side and an exterior side in sliding engagement with the base portion. The cover portion is movable between a first position wherein the batten recess is exposed and a second interlocked position wherein the batten recess is enclosed by the cover portion. The cover portion and the base portion include releasable interlocking elements which cooperate to releasably interlock the cover portion in the second position. In this way, a batten terminal end is secured to the bracing sleeve upon slidably engaging the cover portion from the first position to the second position with the batten end positioned within the base portion recess.

In another aspect, the present invention is directed to a sign assembly which includes a flexible sheet of material in the form of a sign having a display surface and an opposing bracing surface. A first batten has terminal ends for engaging the flexible sheet along a first bracing axis of the bracing surface. A second batten has terminal ends and is secured to the first batten. The second batten can be oriented along a second bracing axis of the bracing surface. The sign assembly also includes at least one bracing sleeve having a base portion and a cover portion. The base portion of the sleeve is affixed to the bracing surface at a location along one of the first and second bracing axes. The base portion includes a batten recess for receiving a batten terminal end. The batten recess is defined by walls disposed along longitudinal sides of the base portion in opposing relation and extending outwardly from the base portion. At least one of the walls defines a track along the base portion longitudinal sides. The base portion includes an aperture proximate an end. The cover portion is in sliding engagement with the walls between a first position wherein the batten recess is exposed and a second interlocked position wherein the batten recess is enclosed by the cover portion. The cover portion includes at least one flexible arm extending from the cover portion. The flexible arm is biased outwardly into position within the base portion track. The flexible arm includes a tab for engaging the aperture when the cover portion is in the second position. In this way, the cover portion is releasably interlocked in the second position by the seating of the tab within the aperture and released by compressing the tab of the flexible arm inwardly to unseat the tab from the aperture to permit the cover portion to slide from the second position to the first position to insert the batten end in the batten recess of the base portion.

BRIEF DESCRIPTION OF THE SEVERAL VIEWS OF THE DRAWINGS

The foregoing summary as well as the following detailed description of the preferred embodiment of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown. In the drawings.

DETAILED DESCRIPTION OF THE INVENTION

Figure 1:
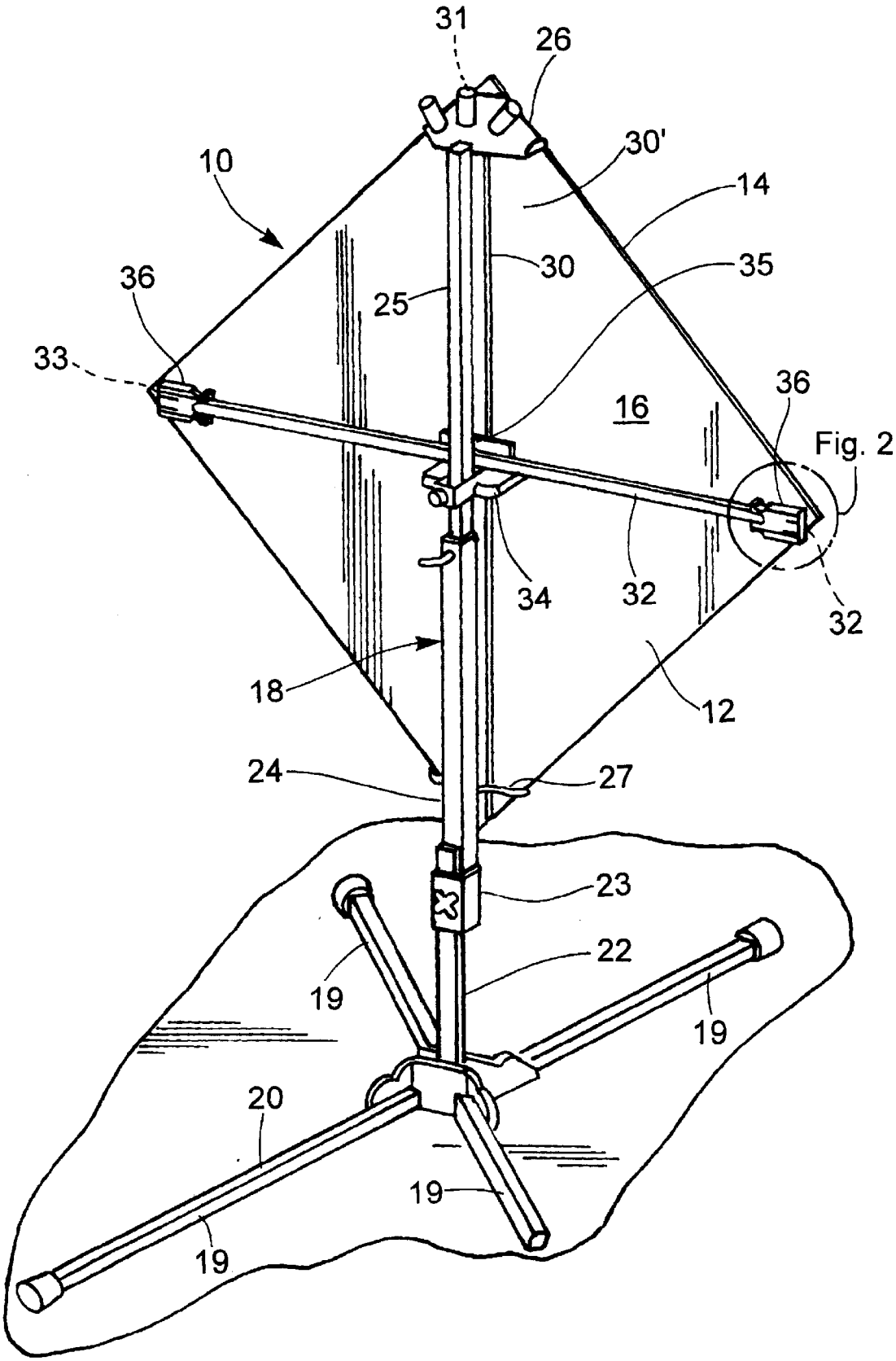
FIG. 1 is a rear perspective view of a sign assembly employing the bracing sleeves in accordance with a preferred embodiment of the present invention.

Certain terminology is used in the following description for convenience only and is not limiting. The words "right,"

"left," "lower," and "upper" designate directions in the drawings to which reference is made. The words "inwardly" and "outwardly" refer to directions toward and away from, respectively, the geometric center of the sign assembly and bracing sleeve in accordance with the present invention, and designated parts thereof. The use of the term "a" in the claims is defined to mean "at least one." The terminology includes the words noted above as well as derivatives thereof and words of similar import.

The bracing sleeve described herein is provided for use with collapsible sign assemblies such as those typically found on roadways which must be quickly deployed, requiring a minimum of assembly time and effort.

Referring now to the drawings in detail, wherein like numerals indicate like elements throughout, there is shown in FIG. 1, a portable collapsible sign assembly, generally designated 10, in accordance with the present invention. The sign assembly 10 includes a flexible sheet of material 12 in the form of a sign and being made of high strength light weight material, such as retroreflective microprism polyvinyl chloride (PVC) sheeting permanently heat-sealed to a vinyl coated fabric reinforced backing material. The sheet 12 has a front face or "display surface" 14 and a rear face or opposing bracing surface 16. The sheet 12 is preferably generally square in shape but may have other shapes such as circular or rectangular (not shown). On the front face 14 of the sheet 12 there is provided indicia (not shown) such as "CONSTRUCTION AHEAD", "STOP", "SLOW", "MEN WORKING", etc.

The sheet 12 is tensioned by first and second battens 30, 32 having terminal ends 30' and 32' for engaging the flexible sheet 12 along first and second bracing axes 31, 33, respectively of the bracing surface 16. The first and second battens 30, 32 are preferably semi-flexible rigid members which are generally rectangular in cross section. The first batten 30 is pivotally secured to the second batten 32 at a generally centrally disposed pivot point 35. The battens 30, 32 are joined at their centers by means of a rivet or bolt (not shown), and are swiveled relative to each other and retained by a sign mounting bracket 34 of the frame 18. The sign mounting bracket 34 is conventional and well understood by those of ordinary skill in the art. Accordingly, further description of the sign mounting bracket 34 is omitted for purposes of brevity.

The terminal ends 30' and 32' of the first and second battens 30, 32 are preferably coupled to oppositely disposed portions of the sheet 12 in the following manner. The first batten 30 is preferably riveted or otherwise permanently secured to the sheet 12 at oppositely disposed terminal ends and at positions intermediate the terminal ends. The first batten 30 extends across opposite corners thereof along the first bracing axis 31.

A mechanical interlocking slide pocket 36 (hereafter referred to as a bracing sleeve) attached by means of a permanent anchor (hereafter referred to as an anti-tear member) to each of the remaining two oppositely disposed corners of the flexible sheet 12, as described in more detail hereinafter. The bracing sleeve 36 receives and retains the oppositely disposed terminal ends 32' of the second batten 32 along the second bracing axis 33. Both bracing sleeves 36 are identical. (It should also be noted that a bracing sleeve 36 may be attached at the two oppositely disposed corners of the sign supported by the first batten 30, if so desired. Should that be the case, all four bracing sleeves 36 would be identical.) Hence, only the bracing sleeve 36 shown in FIG. 1 is described in detail.

Referring now to FIGS. 2–7, the bracing sleeve 36 includes a base portion 37 and a cover portion 40. The base portion 37 of the bracing sleeve 36 is in sliding engagement with a movable cover portion 40. The base portion 37 has upstanding side walls 44 disposed along longitudinal sides of the base portion 37 in opposing relation and extending outwardly from the base portion 37. A batten recess 46 is defined as the area interior to the side walls 44 for receiving a terminal end 32' of the batten 32. The walls 44 define tracks 43 along the base portion longitudinal sides.

The base portion 37 and the cover portion 40 are preferably constructed of a generally rigid polymeric material. More particularly, it is preferred that the base portion 37 and cover portion 40 are constructed of different polymeric materials to reduce the coefficient of friction therebetween. This increases the respective slidability between the base portion 37 and the cover portion 40. To this end, it is preferred that the base portion 37 be constructed from the polycarbonate family of resins such as GE Lexan, and the cover portion 40 be constructed from the acetyl family of resins, such as Amilus S71. It is understood by those of ordinary skill in the art from this disclosure that the present invention is not limited to constructing the bracing sleeve 36 of any particular material.

Figure 6:
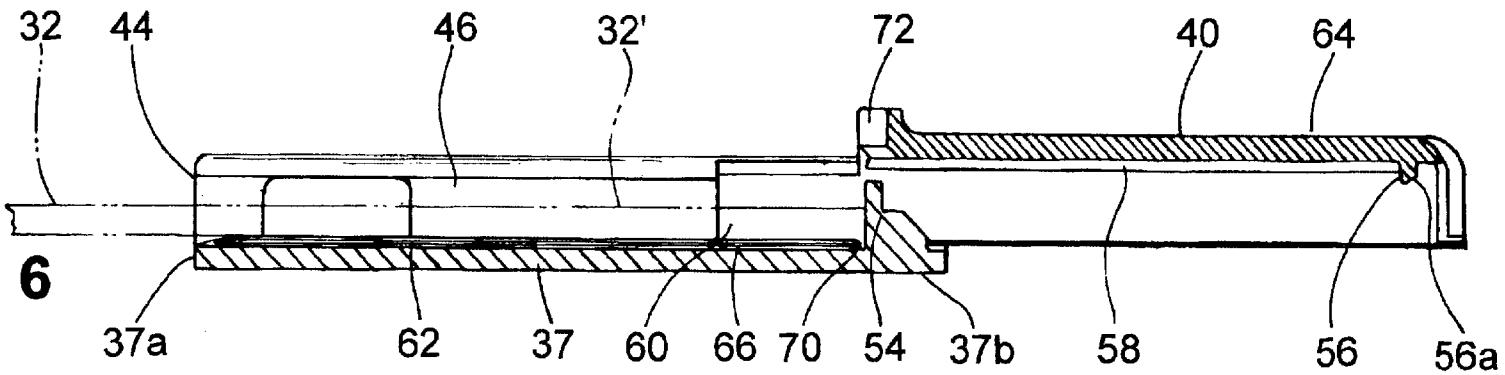
FIG. 6 is a sectional view of the bracing sleeve shown in FIG. 3 taken along the line 6—6 in FIG. 3.
Figure 7:
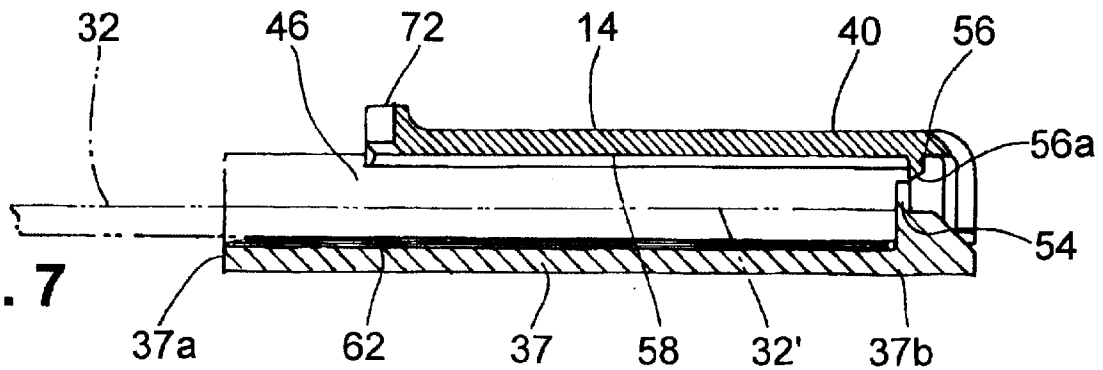
FIG. 7 is a sectional view of the bracing sleeve shown in FIG. 4 taken along the line 7—7 in FIG. 4.

The base portion 37 includes a backstop 54 at an end of the tracks thereof (shown in FIGS. 6–7). The backstop 54 is an upstanding generally vertical wall for abutting a portion of the cover 40, as described in detail hereinafter. The side walls 44 include tab apertures 50 at corresponding ends. The tab apertures 50 are located opposite the backstop 54. The base portion 37 includes transition sections 48 which gradually curve inwardly from the side walls 44, and are substantially perpendicular with respect thereto. The transition sections 48 together with the side walls 44 define the curved tracks 43 along opposing longitudinal sides of the base portion 37 for engaging the cover portion 40.

Figure 3:
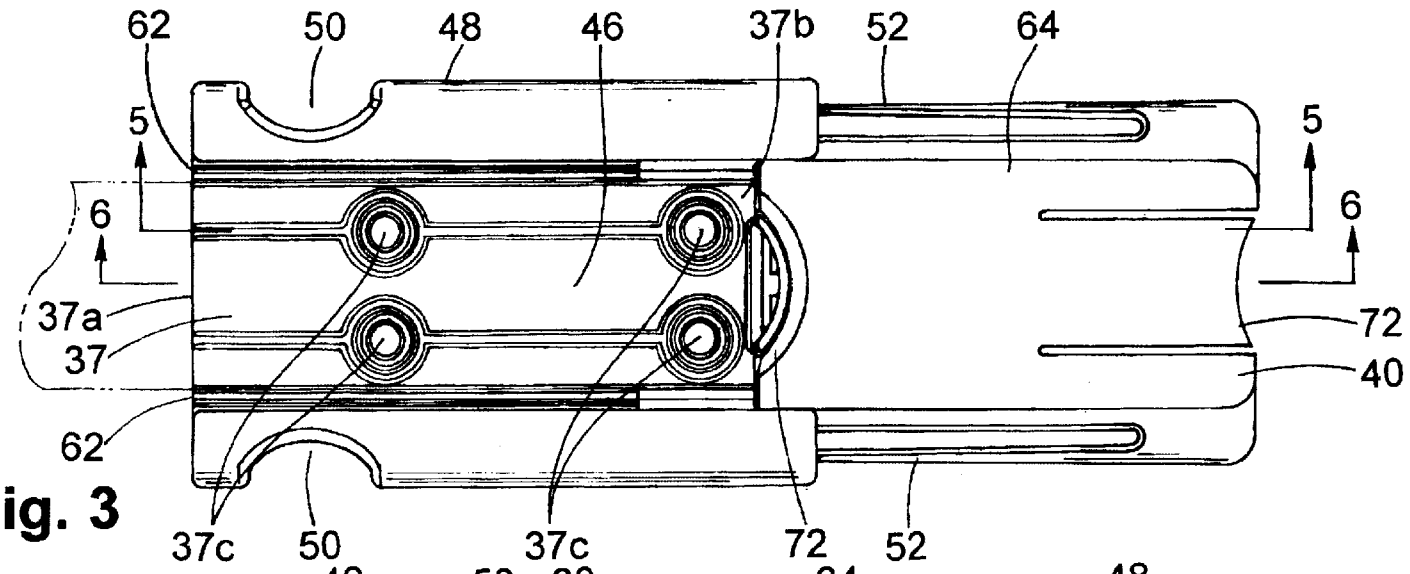
FIG. 3 is a top view of the bracing sleeve shown in FIG. 2 showing the cover in the first position.

Referring now to FIG. 3, the base portion 37 includes a batten recess end **37*a* and a cover portion end 37*b*, at least one groove or "slot" 62, and preferably two slots 62 extend along the base portion 37 and parallel to the tracks 43 from the batten recess end 37*a* toward the cover portion end 37*b* for slidably receiving a portion 66 of the cover portion 40 to guide the cover portion 40 along the tracks 43 of the base portion 37. Each slot 62 is parallel and adjacent to a corresponding track 43 for receiving the cover portion 40. The slots 62 include an end 62*b* which is spaced from the cover portion end 37*b* to prevent the cover portion 40 from being separated from the base portion 37 as the cover portion 40** moves from the second position to the first portion (described below).

Figure 2:
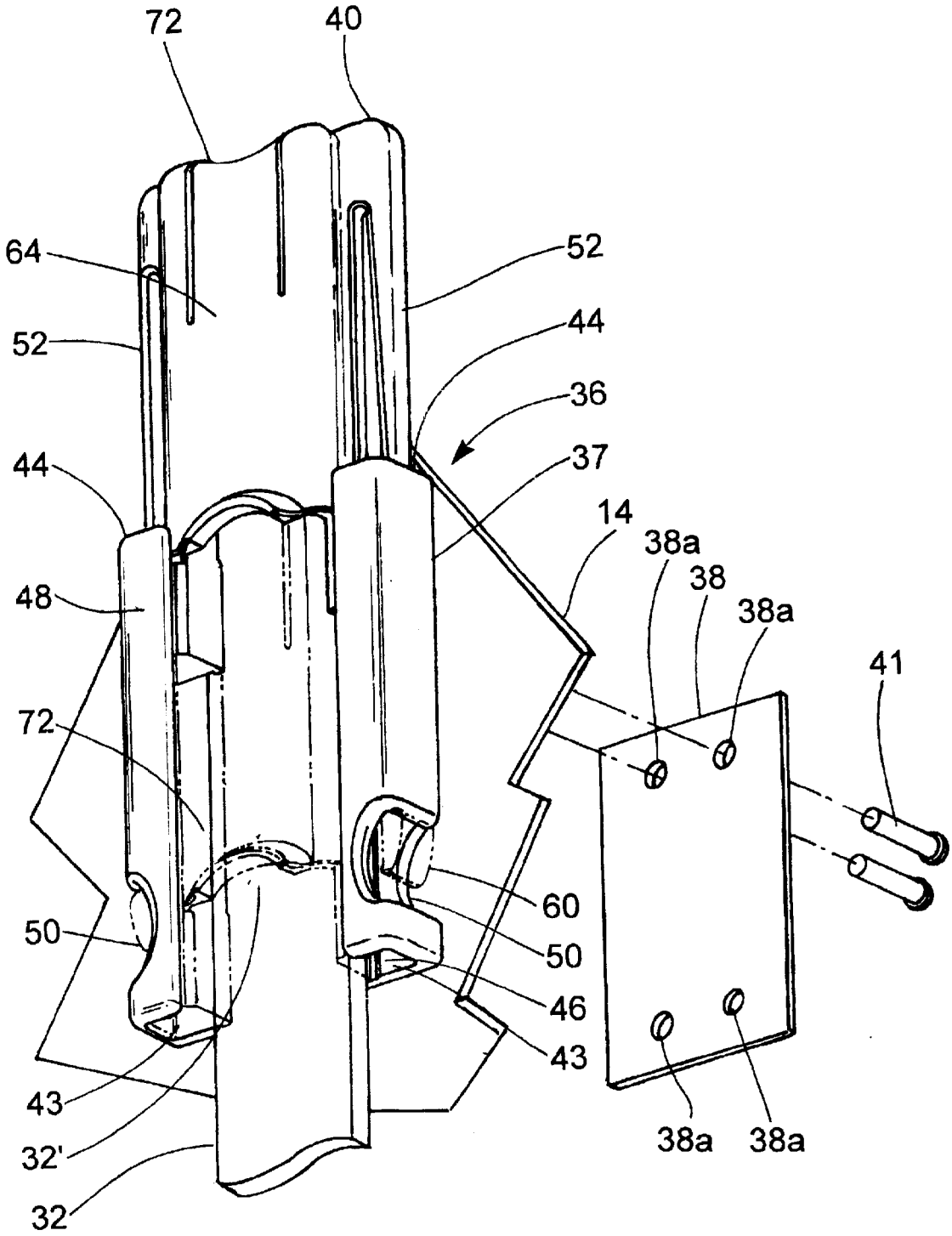
FIG. 2 is an enlarged, partially exploded fragmentary view of the structure embraced by the dotted circle in FIG. 1 and rotated 90° counter-clockwise.

As best shown in FIGS. 2 and 3, the flexible sheet 12 is sandwiched between the base portion 37 of the bracing sleeve 36 and an anti-tear member 38. Fasteners 41 extend through aligned holes **37*c*, 38*a*, in the base portion 37 and the anti-tear member 38 respectively. The fasteners 41 are preferably rivets. The fasteners 40 extend through the holes (not shown) in the flexible sheet 12 to thereby secure the flexible sheet 12 to the base portion 37 and anti-tear member 38. The present invention permits the sheet 12 to be rigid or flexible. When the sheet 12 is rigid, the anti-tear members 38** are not needed.

Figure 4:
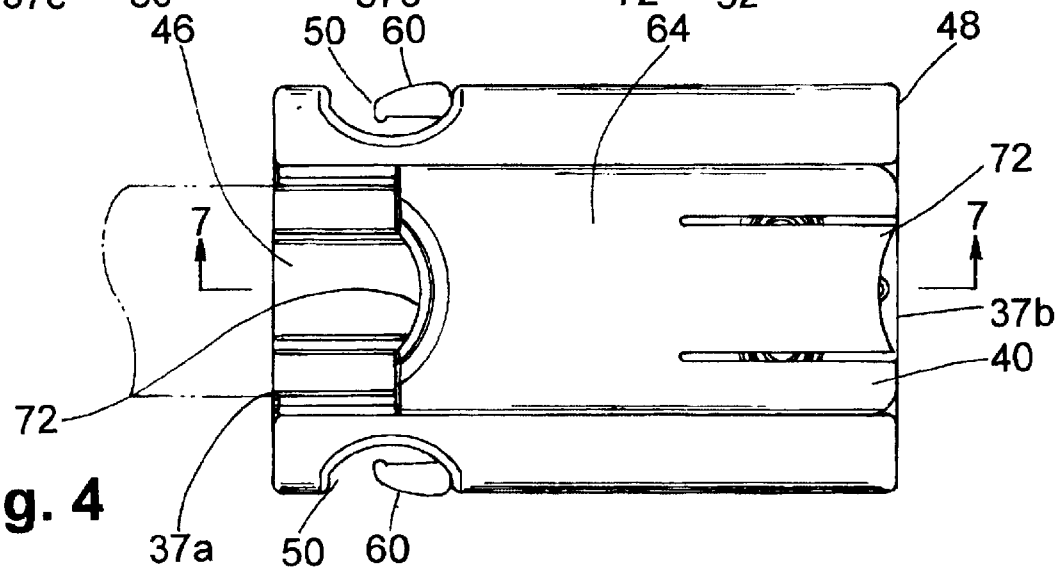
FIG. 4 is top view of the bracing sleeve shown in FIG. 2 showing the cover in the second interlocked position.

As shown in FIGS. 3–4, the cover portion 40 is reciprocally disposed along the tracks between a first position (shown in FIG. 3) wherein the batten recess 46 is exposed and a second interlocked position (shown in FIG. 4) wherein the batten recess 46 is enclosed by the cover portion 40. The cover portion 40 and the base portion 37 include releasable interlocking elements which cooperate to releasably interlock the cover portion 40 in the second position. More particularly, the releasable interlocking elements comprise at least one, and preferably two flexible arms 52 extending from the cover portion 40 along opposing longitudinal edges of the cover portion 40 and are biased outwardly into position within the base portion tracks 43. The flexible arms 52 include bulbous tabs 60 at corresponding ends thereof for engaging said aperture 50 when said cover portion 40 is in the second position to releasably interlock the cover portion 40 in the second position. The cover portion 40 includes raised curved sections 72 at opposing ends of the cover portion 40 for providing convenient locations for applying a finger force to move the cover portion 40 between the first and second positions. The tabs 60 are easily distinguished in low level lighting along with curved sections 72. The flexible arms 52 are biased outwardly into position along the tracks of base portion 37. The cover portion 40 includes a recess side 58 and an exterior side 64. The recess side 58 of the cover portion 40 includes a downwardly extending protrusion 56 for abutting the backstop 54 of base portion 37 to limit the range of motion of the cover portion 40 as shown in FIG. 7. The terminal end 56*a* of the protrusion 56 is chamfered to facilitate assembly of the bracing sleeve 36, as described in more detail hereafter.

As shown in FIG. 1, the frame 18 of sign assembly 10 preferably includes ground-engaging elements in the form of a collapsible support 20. The legs 19 of the support 20 are adapted to pivot upwardly to a collapsed position. The support 20 is connected to an upright member 22 which may be flexible if desired to provide adjustable wind deflectabilty. The member 22 is connected to a collar 23 which receives the lower end of a tubular frame member 24. The member 24 is adjustably connected to an extension 25. A flag, light holder, and upper sign corner retaining bracket 26 may be attached to the upper end of the extension 25 and cooperates with a lower sign corner retaining bracket 27 on the member 24 to thereby embrace opposite corners of the sign, the sign corner retaining bracket 27 embracing and retaining the lower corner of the sign.

Figure 5:
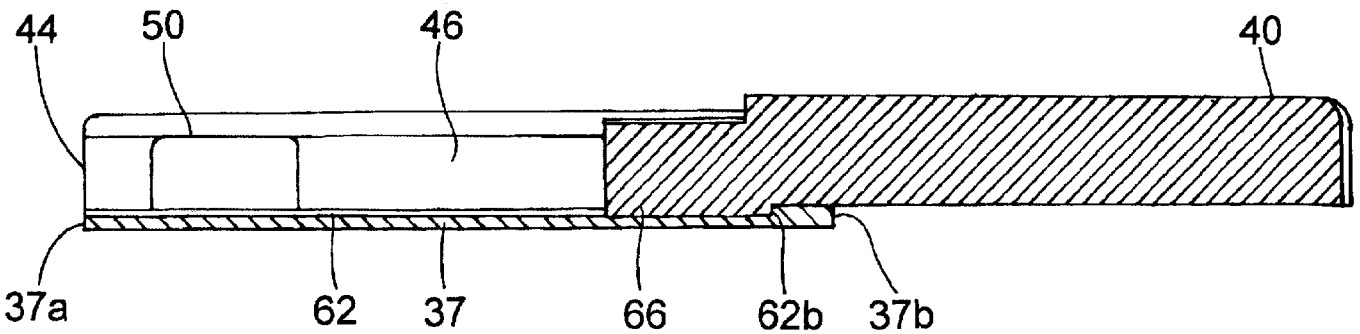
FIG. 5 is a sectional view of the bracing sleeve shown in FIG. 3 taken along the line 5—5 in FIG. 3.

In order to insert a terminal end 32' of the second batten 32 within the batten recess 46, it is necessary to apply a finger force to the tabs 60 with one hand and the curved sections 72 of the cover portion 40 with the other hand. Forcing the tabs 60 inward and away from the apertures 50, enables the cover portion 40 to be moved from the from the second position (shown in phantom in FIG. 2) to the first position. The cover portion 40 is moved toward the second position until a tab portion 66 positioned within the slots 62 abuts the end 62*a* of the slots 62, as shown in FIG. 5. In this way, a terminal end 32' of the second batten 32 is positionable within the batten recess 46 of the base portion 37 to secure the second baton 32 within the bracing sleeve 36, the cover portion 40 is returned to the second position where the tabs 60 interlock with the apertures 50 of the side walls 44. The protrusion 56 abuts the backstop 54 so that the tabs 60 of the flexible arms 52 sit snugly in the apertures 50 of the side walls 44. The protrusion 56 prevents the user from inadvertently compressing the tabs 50 inwardly and sliding the cover portion to the left as viewed in FIGS. 3 and 4 by engaging the backstop as shown in FIG. 7.

Because the terminal ends 32' of the second batten 32 can be disposed within the batten recesses 46 without flexing the second batten 32, it is permissible to rivet the first batten 30 to the flexible sheet of material 12 along its length. This functions as a secondary restraint to keep the flexible sheet of material 12 from bowing because of wind impacting the rear side of the flexible sheet of material 12. This is a significant advantage over the use of velcro straps for the same purpose.

After the terminal ends 30', 32' first and second batten 30, 32 are released from the bracing sleeves 36, they are separated from the support member 34 of the frame 18. Thereafter, the first and second batten 30, 32 may be manually swiveled to overly their mating batten. Thereafter, the flexible sign 12 is wrapped around the first and second battens 30, 32. The frame 18 is in this way collapsed by lowering the extension 25 and pivoting the legs of the support 20 upwardly.

The cover portion 40 and the base portion 37 of bracing sleeve 36 are assembled together by sliding the cover portion 40 into the opposing tracks 43 of the base portion 37 starting from the batten recess end 37*b*. The tab portion 66 of cover portion 40 is seated in slots 62. The cover portion 40 is moved from left to right (as viewed in FIG. 3). The flexible arms 52 are biased outwardly into position within the base portion tracks 43. The curved wall section 72 of the cover portion 40 is raised away from the base portion 37 by the chamfer 56*a* of the protrusion 56 as it passes beyond the backstop 54. Once assembled, the tabs 60 of the flexible arms 52 sit snugly in the apertures 50 of the side walls 44 when reaching the first position and the tab portion 66 is positioned within the slots 62 to abut the end 62*b* of the slots 62, as shown in FIG. 5 when the cover 40 is moved to the second position.

It will be appreciated by those skilled in the art that changes could be made to the embodiment described above without departing from the broad inventive concept thereof. It is understood, therefore, that this invention is not limited to the particular embodiment disclosed and is not intended to exclude known equivalents, thus it is intended to cover modifications within the spirit and scope of the present invention.

I claim:

1. A sign assembly, comprising:

a flexible sheet of material in the form of a sign having a display surface and an opposing bracing surface;

a first batten having terminal ends for engaging the flexible sheet along a first bracing axis of the bracing surface;

a second batten having terminal ends and being oriented along a second bracing axis of the bracing surface;

at least one bracing sleeve having a base portion and cover portion, said base portion of the sleeve being affixed to the bracing surface at a location along a bracing axis;

(i) the base portion including a batten recess for receiving a one of said batten terminal ends, the batten recess being defined by walls disposed along longitudinal sides of said base portion in opposing relation and extending outwardly from said base portion, said walls defining tracks along the base portion longitudinal sides;

(ii) the cover portion, including a recess side and an exterior side, in sliding engagement with the base portion, said cover portion being movable between a first position wherein the batten recess is exposed and a second interlocked position wherein the batten recess is enclosed by the cover portion, said cover portion and said base portion including releasable interlocking elements which cooperate to releasably interlock the cover portion in the second position;

whereby a batten terminal end is secured to the bracing sleeve upon slidably engaging the cover portion from the first position to the second position with the batten end positioned within the base portion recess.

2. The sign assembly of claim 1 further comprising:

a backstop located at an end of the tracks; and a protrusion located on the recess side of said cover portion for abutting said backstop upon slidably engaging said cover portion from the second position to the first position whereby the range of motion of the cover portion is limited.

3. The sign assembly of claim 1 wherein the base portion walls curve inwardly toward each other to define curved tracks for engaging the cover portion.

4. The sign assembly of claim 1 wherein the base portion includes a batten recess end and a cover portion end and further includes at least one slot extending along said base portion and parallel to the tracks from said batten recess end forward said cover portion end for slidably receiving a portion of the cover portion to guide the cover portion along the tracks of the base portion.

5. The sign assembly of claim 4 wherein said at least one slot is spaced from said cover portion end to prevent said cover portion from being separated from said base portion when said cover portion is moved from said second position to said first position.

6. The sign assembly of claim 1 wherein the at least one bracing sleeve is constructed of a polymeric material.

7. The sign assembly of claim 1 wherein the first batten is pivotally secured to the second batten at a pivot point.

8. The sign assembly of claim 1 wherein at least one wall of the base portion includes an aperture proximate an end thereof.

9. The sign assembly of claim 8 further comprising:

said releasable interlocking elements comprising at least one flexible arm extending from the cover portion and being biased outwardly into position within said base portion track, the flexible arm including a tab for engaging said aperture when said cover portion is in said second position to releasably interlock the cover portion in said second position.

10. A sign assembly, comprising:

a flexible sheet of material in the form of a sign having a display surface and an opposing bracing surface;

a first batten having terminal ends for engaging the flexible sheet and fixed along a first bracing axis of the bracing surface;

a second batten having terminal ends and secured to the first batten such that the second batten can be oriented along a second bracing axis of the bracing surface;

at least one bracing sleeve having a base portion and cover portion, said base portion of the sleeve being affixed to the bracing surface at a location along one of said first and second bracing axes;

(i) the base portion including a batten recess for receiving a one of said batten terminal ends, the batten recess being defined by walls disposed along longitudinal sides of said base portion in opposing relation and extending outwardly from said base portion, at least one wall defining a track and including an aperture proximate an end thereof;

(ii) the cover portion being in sliding engagement with the walls between a first position wherein the batten recess is exposed and a second interlocked position wherein the batten recess is enclosed by the cover portion, said cover portion including at least one flexible arm extending from the cover portion and being biased outwardly into position within said base portion track, the flexible arm including a tab for engaging said aperture when said cover portion is in said second position;

whereby the cover portion is releasably interlocked in the second position by the seating of the tab within the aperture and released by compressing the tab of the flexible arm inwardly to unseat the tab from the aperture to permit the cover portion to slide from the second position to the first position to insert the batten end in the batten recess of the base portion.

11. The sign assembly of claim 10 further comprising:

a backstop located at an end of the tracks; and a protrusion located on the recess side of said cover portion for abutting said backstop upon slidably engaging said cover portion from the second position to the first position whereby the range of motion of the cover portion is limited.

12. The sign assembly of claim 10 wherein the base portion walls curve inwardly toward each other to define curved tracks for engaging the cover portion.

13. The sign assembly of claim 10 wherein the first batten is pivotally secured to the second batten at a pivot point.

14. The sign assembly of claim 10 wherein the base portion includes a batten recess end and a cover portion end and further includes at least one slot extending along said base portion and parallel to the tracks from said batten recess end toward said cover portion end for slidably receiving a portion of the cover portion to guide the cover portion along the tracks of the base portion.

15. The sign assembly of claim 10 wherein said at least one slot is spaced from said cover portion end to prevent said cover portion from being separated from said base portion when said cover portion is moved from said second position to said first position.

* * * * *